United States Patent [19]

Stahlecker et al.

[11] 4,178,749

[45] Dec. 18, 1979

[54] METHOD AND APPARATUS FOR EXECUTION OF A PIECING PROCESS

[76] Inventors: Fritz Stahlecker, Josef-Neidhart-Strasse 18, 7341 Bad Überkingen; Hans Stahlecker, Haldenstrasse 20, 7334 Suessen, both of Fed. Rep. of Germany

[21] Appl. No.: 909,465

[22] Filed: May 25, 1978

[30] Foreign Application Priority Data

Jun. 3, 1977 [DE] Fed. Rep. of Germany ..... 2725105

[51] Int. Cl.[2] ..... D01H 15/00; D01H 1/12; D01H 1/32

[52] U.S. Cl. ..... 57/263

[58] Field of Search ..... 57/34 R, 58.89–58.95, 57/263

[56] References Cited

U.S. PATENT DOCUMENTS 3,780,513 12/1973 Watanabe et al. ..... 57/263 X
4,047,371 9/1977 Stahlecker ..... 57/34 R
4,080,775 3/1978 Stahlecker ..... 57/34 R

*Primary Examiner*—Donald Watkins
*Attorney, Agent, or Firm*—Craig and Antonelli

[57] ABSTRACT

A method and apparatus for yarn piecing on an open-end spinning machine is provided which includes a plurality of predetermined working programs for carrying out the piecing steps. To accommodate automated provision of quality pieced places in the yarn being spun, a yarn monitoring device is provided for detecting the quality of the piece place in the yarn, which device generates a signal controlling the selecting of one of the predetermined working programs for the next piecing operation at the spinning assembly. In particularly preferred embodiments, a storage device is provided for storing information as to the particular working program utilized during the last successful piecing operation at the respective spinning assemblies, with retrievability of this stored data to select the same successful piecing program for the subsequent piecing operation at such spinning assembly.

34 Claims, 7 Drawing Figures

1
2
3
4
5
6
7
8
9
10
11
12
13
14
15
16
18
19
20
21
22
23
24
25
26
27
28
29
30
31
32
33
34
35
36
37
38
39
40
41
42
43
44
45
46
47
48
49
50
51
52
53
54
55
56
57
58
59
60
61
62
63
64
65
66
67
68
69
70
71
72
73
74
75
76
77
78
79
80
81
82 v
$v_B$
$v_Ü$ $t_a$
$t_e$
$-v_R$
II
$t_A$
$t_B$
t
n
$n_B$
$n_A$ $t_R$
$t_0$
$t_A$
$t_B$
t
w
$w_B$
$w_Ü$ $w_V$
$t_1$
$t_2$
$t_3$
$t_A$
$t_B$
t
p $p_A$
$t_A$
$t_B$
t

METHOD AND APPARATUS FOR EXECUTION OF A PIECING PROCESS

BACKGROUND AND SUMMARY OF THE INVENTION

The invention relates to an improved method and apparatus or device for execution of a piecing process on an open end spinning assembly, in which, controlled by a program control, a yarn end is taken from the spinning assembly and prepared, like the spinning assembly, for the piecing process, and in which there are operations engaging in the spinning assembly for execution of the piecing process, whereafter the pieced yarn is transferred to the spinning assembly.

In a known piecing device (German OS No. 2,360,296; corresponding U.S. Pat. No. 3,987,610), it is provided that the piecing device will first execute preparatory operations in which the broken yarn end is taken from a winding device and brought inside the piecing device in a prepared condition and then brought into the zone of a yarn draw-off passage of a spinning assembly, in which passage the prepared yarn end is held ready for the actual piecing process. Preparatory operations on the spinning assembly, such as cleaning or the like, may also belong to the preparatory operations. For the subsequent execution of the actual piecing process, the piecing device provides that sliver feed will occur in a suitable way, and that the prepared yarn end will be led back into the spinning rotor and then drawn off again. This entails engagement or control of the sliver feed device. Moreover, there is intervention in the rotor drive, to make use of the circumstance that the spinning rotor, in running up to its operational rotational speed (rpm—revolutions per minute), passes through a range that is particularly favorable for piecing. The pieced yarn is subsequently transferred by a transfer device to the spinning assembly. The switching in points and the period of switching in of the individual elements of the piecing device are controlled by a program control. This piecing device has results that in themselves are satisfactory, i.e. piecings are obtained whose tear strength and appearance are such that they can be accepted in the produced yarn without need to clear these pieced places from the yarn.

However, in practice it has been determined that despite acceptable functioning of the piecing device, pieced places with different appearance and different quality occur on the individual spinning assemblies, where in extreme cases it even goes so far that the piecing process fails, so that no yarn can be pieced. This is essentially apparently caused by the fact that the mechanical devices of the spinning assembly that are controlled by the piecing device in the course of the piecing process have to be switched or utilized in other ways, to be distinguished as to functioning with respect to the other individual spinning assemblies. For example, it is to be observed that because of manufacturing tolerances there are slight deviations in the working of the feed devices and also in the running up behavior of the spinning rotors at the respective spinning assemblies of a given spinning machine. These unavoidable differences that are caused by manufacturing tolerances must be taken into account in design of the piecing device in such a way that, in spite of these deviations, there will be an adequate reliability in piecing. This means that in many cases, with previously contemplated piecing apparatus, thicker pieced places will be produced than would actually be necessary or desirable.

The invention deals with the problem of creating a process of the type in question whereby the percentage of successful piecing operations will be improved, and also the quality of the pieced places will be improved so far as possible. The invention contemplates providing that the pieced yarn is checked for the presence and/or the quality of the pieced place, and that depending upon the test results or detected parameters, transfer to the spinning assembly will occur or the piecing process will be interrupted with subsequent repetition of the piecing operation, whereby there will be a changed program control in the repeated piecing process, at least for the operations that engage in the spinning assembly.

By the process according to the invention, at least the reliability of the piecing operation will be substantially increased, if, for example, the piecing process has failed and there is no pieced place, the program control will automatically be so changed that a socalled "safety piecing" will be obtained, so that continued operation is possible. This feature of the invention is here based on the determination by the inventors that it is not very worthwhile to repeat a piecing operation with the same program if this piecing operation has once failed. It is basically not to be expected then that a substantially better result would come from the second attempt.

With use of the different programs, tolerance-caused deviations between the individual spinning assemblies can be balanced out in such a way that essentially there will be the production of uniform piecings at all assemblies. It is a question of optimization of the design of the control element here, whether only the reliability of the piecing device will be increased, or whether there will also be improvement in the quality of the piecing. If only reliability is to be increased according to certain preferred embodiments of the present invention, it suffices in most instances to make relatively simple changes in the program control. If, however, the quality of the yarn piecing is to be taken as the decisive criterion according to certain other preferred embodiments of the present invention, then in some situations a number of piecing tests will have to be effected with various changes in the program control.

If, for example, the piecing process has failed, it may be because not enough sliver was fed into the spinning rotor to make a sufficiently thick sliver ring. This could be taken into account according to the present invention by a change in the program control that advances the time for start of sliver delivery. If, with this program change, the repeated piecing process were to fail again, its cause could be a poor quality of the yarn end supplied to the spinning rotor. It could be that, shortly before the yarn break which is supposed to now be corrected by the piecing operation, there was already a poor yarn being produced. In this case, for the third piecing attempt, another program change could be provided according to the present invention, so that the preparatory operation would involve a longer yarn length being wound off and only thereafter would there be preparation of the yarn end for the piecing process.

Embodiments of the invention are also contemplated where it is provided that the control element will automatically decide, in dependence of the result of testing of the piecing or determination of the absence of a piecing, in what way the program needs to be changed. If, for example, a greater or less quantity of sliver should be delivered and/or other work steps should occur earlier or later or be sustained for a longer period, the control element will react accordingly. However, it may also be provided according to other preferred embodiments of the invention, that the control element will always transmit the same signal, indpendently of the occurring defects, said signal triggering a specified series of experimental program changes with respective individual piecing attempts.

In an advantageous embodiment of the invention, a device for execution of the process is created in that a control element is provided for checking the pieced yarn and/or the pieced place in the yarn, which is connected via a pickup with the program control which is equipped with control elements controlled by the pickup, for interruption and repetition of the piecing process and also with switching elements controlled by the pickup which elements are connected to work programs in the program control which differ from one another, for devices for execution of the piecing process.

In order to avoid that a plurality of piecing trials will have to be undertaken in each piecing operation, in an advantageous embodiment of the inention, it is provided that the switching device is connected with the signal output of a storage in which there is stored a switching signal that is associated with the successful work program of the spinning assembly in question. This means then, that an attempt to effect a piecing after a yarn break on a spinning assembly will be made with the work program that is identical with the work program that was successful for eliminating the previous yarn break at this spinning assembly.

Advantageously, an optically, capacitively, or inductively operating yarn testing head acts as control element, being disposed in the yarn path for the pieced yarn and determining variations in cross-section of the yarn. Here it is advantageous if the said yarn test head is as close as possible to the spinning assembly because then when there is a defect not too much yarn will have run into the piecing device, or onto the spool of the spinning assembly. In order to provide a qualitative determination with respect to the piecing and thereafter to allow automatic decisions to be made near the program control, it is provided in certain preferred embodiments that a signal transmitter connected to the yarn testing head will convert the measurement of the yarn testing head into signals that are associated with the time of appearance of the pieced place in the testing head and/or the thickness of the pieced place and/or the length of the pieced place.

Because the difficulties to be avoided by the present invention essentially are caused by differences in the individual spinning assemblies, it is provided in an advantageous embodiment of the invention that the work programs will differ with reference to time of switch-in and/or duration of the switched-on period of a device for delivery of sliver and/or a device to start the run up of the spinning rotor and/or a device for carrying the yarn end back into the spinning rotor and for drawing off the pieced yarn again. Then only that part of the program control will be changed that concerns the operations which in any way are dependent upon the function of the individual spinning assembly.

These and further objects, features, and advantages of the present invention will become more obvious from the following description when taken in connection with the accompanying drawings which show, for purposes of illustration only, several embodiments in accordance with the present invention.

DETAILED DESCRIPTION OF THE DRAWINGS

Figure 1:
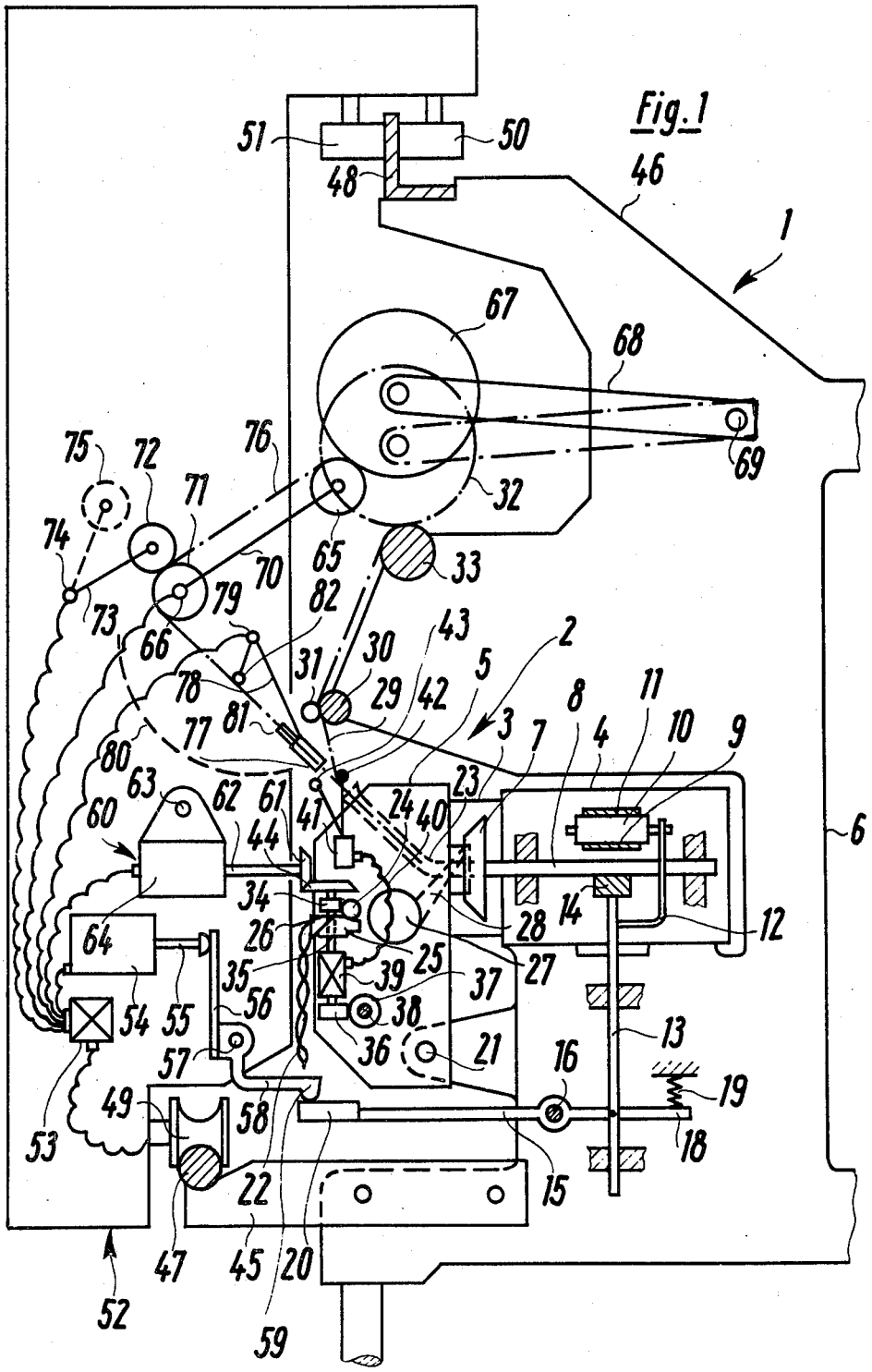
FIG. 1 is a cross-sectional schematic view through an open end spinning machine in the region of a spinning assembly and a mobile servicing device presented to the spinning assembly for execution of a piecing operation and constructed in accordance with a preferred embodiment of the present invention.

In the drawings and in the following description, certain details of an actual spinning machine and servicing device are omitted in order not to obscure what applicants consider as their present invention. Further, such details should clearly not be needed by one skilled in the art in order to practice and use the present invention, in view of the state of the art. By way of background information and a possible aid in understanding the present invention, reference is hereby made to commonly owned U.S. Pat. Nos. 3,892,062; 3,924,393; 3,924,394; 3,942,311; 3,950,926; 3,987,610; 4,043,106; 4,047,371; 4,080,775; and 4,084,398.

FIG. 1 schematically shows the cross-section through an open end spinning machine 1 in the region of a spinning assembly 2, which machine 1 consists of a plurality of such spinning assemblies 2 arranged side-by-side. Each spinning assembly 2 presents essentially three housings 3, 4, and 5 which are fixed to a frame 6. Housing 3 is connected to a vacuum source and receives a spinning rotor 7. Shaft 8 of spinning rotor 7 is borne in housing 4 and is driven by a tangential belt 9. Tangential belt 9 is pressed in the operational state by a pressure roll 10 on shaft 8, which roll 10 also guides the returning segment 11 of tangential belt 9. In the state illustrated in FIG. 1, in which spinning rotor 7 is stopped, roll 10 is lifted off rotor shaft 8, and therewith also drive belt 9 is lifted from shaft 8. For this purpose, pressure roll 10 is coupled via a linkage 12 with a brake mechanism 13 which presents a brake jaw 14, which is applied to shaft 8 of FIG. 1. Brake mechanism 13 is coupled with a two-armed brake lever 15 which is swingably mounted about a stationary shaft 16. In operation, the rear arm 18 of brake lever 15 is depressed by a spring 19, whereby brake mechanism 13 moves downward and therewith brake jaw 14 is lifted from shaft 8. At the same time, because of a coupling of link 12 with brake mechanism 13, roll 10 is lowered and thereby tangential belt 9 is applied to rotor shaft 8. The forward arm of brake lever 15 has a contact surface 20, at which the whole brake mechanism is actuatable.

On machine frame 6 there is a stationary shaft 21 about which housing 5 of spinning assembly 2 can be swung down from housing 3. In this way, as necessary, spinning rotor 7 can be exposed and made accessible from the outside. Swingable housing 5 contains essentially the delivery and opening device for a sliver band 22 that is to be spun, as well as a yarn draw-off passage 23. The delivery device contains a feed roll 24, arranged in a known way, and a feed table 25 cooperating with it and spring-biased, as well as an intake hopper 26 for sliver 22. Sliver 22, running inbetween feed roll 24 and feed table 25 and clamped along a nip, presents a sliver beard to a fast running opener roll 27. Opener roll 27 opens sliver 22 in a known way, to form individual filaments, which are taken via a deliver passage 28 to spinning rotor 7 and there in a known way they are spun to form a yarn 29. Spun yarn 29, shown in dot-and-dash lines is drawn by means of draw-off rolls 30 and 31 from yarn draw-off passage 23 and wound on a spool 32 which is also indicated in dot-and-dash lines, said spool 32 being driven by a friction roll 33.

Feed roll 24 is driven via a gear 34 that is connected via a shaft 35 with another gear 36 which is in engagement with a gear 37. Gear 37 is fixed in rotation with a driven shaft 38 that extends along the longitudinal direction of the machine. There is an electromagnetic coupling 39 disposed between gears 34 and 36, said coupling being connected via lead 40 with a yarn monitor switch 41. Yarn monitor switch 41 has a yarn sensor 42 which monitors the presence of yarn 29 and in case of a yarn break deflects into position 43. In this case, yarn monitor switch 41 interrupts the drive of feed roll 24 via electromagnetic coupling 39 which, although gear 36 is still driven as before, stops gear 34 and therewith feed roll 24. There is another tapered gear 44 on shaft 35 of the drive for feed roll 24 which extends somewhat from housing 5. Via this gear 44, the feed can be briefly actuated from the outside during a piecing operation, in a manner described below, independently of any actuation of yarn monitor switch 41.

Rails 47 and 48 are held on the machine frame 6 with supporting arms 45 and 46, said rails extending in the longitudinal direction of the machine. On these rails 47, 48, a servicing instrument 52 can be moved along open end spinning machine 1, on wheels 49, 50, and 51. The weight of servicing instrument 52 is advantageously received by two wheels 49, whereof at least one is driven. Wheels 50 and 51 ensure stability of the instrument 52 in the horizontal direction.

Mobile servicing device or instrument 52 includes means for function elements for piecing, preferably to eliminate a yarn break, whereby only some of these means are illustrated in FIG. 1. The servicing instrument 52 includes, among other things, a program control 53 which is electrically coupled with the travelling mechanisms and also with a plurality of individual drives for the individual function elements. One of these couplings is to an actuating element 54 shown as a lift piston magnet, its piston 55 being applicable against a lever 56 disposed on piecing device 52, said lever 56 being swingable about a shaft 57. There is an actuating arm 58 that is fixed in rotation with lever 56: its contact surface 59 can actuate the forward contact surface 20 of the brake mechanism of spinning rotor 7. In the case shown in FIG. 1, piston 55 of actuating element 54 has been extended and pressed lever 56 toward the right, whereby contact surface 59 has been moved downward. This has caused contact surface 20 of brake lever 15 to be depressed, whereby brake jaw 14 has been applied against rotor shaft 8, and whereby, moreover, tangential belt 9 has been lifted from rotor shaft 8. Spinning rotor 7 is thus temporarily in a braked state. If, controlled by program control 53, piston 55 of actuating element 54 returns toward the left, brake lever 15, urged by spring 19, will again move upward, whereby brake 14 will release rotor shaft 8 and whereby tangential belt 9 will again be applied to rotor shaft 8. Actuating element 54, controlled by program control 53, then triggers the starting time for the running up of spinning rotor 7 and also simultaneously the actual piecing process, with the temporal succession of operating steps.

As long as the yarn sensor is in its inoperative position 43, feed roll 24 is stopped. For this reason, a drive 60 for mobile servicing instrument 52 is provided, which has a tapered gear 61 which can be selectively brought into engagement with tapered gear 44 of spinning assembly 2, which has already been mentioned. Gear 61 is seated on a shaft 62 which can be driven temporarily, preferably with controllable interruptions, by a motor 64 that is swingably movable about shaft 63. In this way, feed roll 24 can be driven by piecing device 52 as long as the yarn sensor is in its inoperative position 43. If the servicing instrument 52 executes no piecing process, tapered gear 61 is swung out, upward, so that engagement with gear 44 is interrupted.

Servicing instrument 52 also has a lift-off roll 65 that can be swung about a shaft 66. Lift-off roll 65 can be applied against spool 32 from below, to lift spool 32 from friction roll 33 into a lifted position 67. Spool 32 is held by an arm 68 that is swingable about a shaft 69 that is fixed to the machine. Lift-off roll 65 is disposed on a lever 70 which presents another auxiliary draw-off roll 71 on its pivot shaft 66, which can be driven with lift-off roll 65, advantageously synchronously in both directions of rotation. Auxiliary draw-off roll 71 cooperates with a pressure roll 72 which can be swung via a lever 73 about a shaft 74 into lifted-off position 75. This raised position 75 makes it possible to lay yarn end 76 which is to be wound off raised spool 67 and pieced, between draw-off roll 71, 75, by means of a swingable suction device that is not illustrated. Pressure roll 75 then assumes position 72, whereby yarn end 76, that is to be pieced, which thereby is guided into servicing instrument 52, can be delivered back to yarn draw-off passage 23. This occurs with cooperation of a yarn transfer clamp 77 whose pivot arm 78 is rotatable about a shaft 79. Yarn transfer clamp 77 can be swung along radius 80 which is indicated by dashed lines. Before transfer of yarn end 76 to yarn draw-off passage 23, operations are advantageously effected, in a way that is not shown in detail, with which yarn end 76 is brought into an especially appropriate state for piecing.

Before yarn end 76 is guided back into spinning rotor 7 and again drawn-off as new-spun yarn, a ring of sliver has to be laid down in spinning rotor 7, to which yarn end 76 will be applied. Production of this sliver ring is controlled by drive 60 of the servicing instrument 52 during piecing, and sustained until the yarn sensor of yarn monitor 41 assumes its operational position 42 and thereby switches in the device for delivery of sliver, of spinning assembly 2 in question. Servicing instrument 52 has a number of other function elements that are not illustrated, whereby the pieced yarn is transferred after these processes in a predetermined way to the yarn guide elements of the spinning assembly. Program control 53 of mobile servicing instrument 52 determines the succession and the course of the individual process steps necessary for the piecing until the yarn is finally transferred again to spinning assembly 2.

Open end spinning machines today work at 70,000 rpms (rotor speed revolutions per minute) or more. Since it is not appropriate to effect a piecing operation at such high speeds, it is often provided that during the piecing there will be lower rpm. Here it is advantageous if the circumstance is exploited that the spinning rotor 7 in a run up (during acceleration) from a previously braked state passes through a specific speed range that is especially suitable for a piecing operation. Since open end spinning machines in general are so constructed that the spinning rotor of a spinning assembly can be braked independently of the spinning rotors of adjacent assemblies, it suffices for the whole intervention of the servicing instrument 52 in the drive of the spinning rotors 7 of the open end spinning assembly 2, to provide a possibility for actuation of the brake mechanism of spinning rotor 7.

The work steps or succession of operations of the function elements of servicing instrument 52 must be very precisely adjusted to each other in time, in order to produce acceptable piecing. This offers no difficulties as far as the function elements are concerned since they operate within the servicing instrument and are not dependent upon influences of the spinning assembly. Servicing instrument 52 or its program control 53 can simply be so designed, and possibly so adjusted by means of experiments, that there will be optimal adjustment of the work steps to each other, and their temporal succession for each piecing process will remain exactly the same. Such a design and adjustment is not possible, however, for the temporal succession of work steps that engage in the spinning assembly 2 in question and that, with the help of devices of this spinning assembly, trigger part operations of the whole piecing process.

Because of unavoidable tolerances because of dimensional deviations in the region of the individual spinning assemblies, differences occur here. These differences show up strongly because it is precisely these work steps or series of operations that have an essential influence on the success of the piecing attempt and on the quality of the piecing. For piecing, a sliver ring has to be laid down in the spinning rotor 7 of a spinning assembly 2, on which the yarn end is then applied, subsequently to be drawn off. The sliver ring must be made of an exactly determined quantity of sliver so that on the one hand piecing will be possible and on the other hand the product will be a good piecing. Precisely in the region of the sliver feed devices which in the illustrated embodiment of FIG. 1 consist of a feed roll 24 and a feed table 25, there are deviations which can be caused, for example, by different pressure forces with which the feed table is pressed against the feed roll 24 at the individual spinning assemblies 2.

The times at which the yarn end is applied to the sliver ring in the spinning rotor and then again drawn off are important. The time of application is adjusted on the sliver ring, i.e. in a temporal relationship to the feed of the sliver which forms the ring that is necessary for the piecing operation. This can simply be established by the servicing instrument. However, the drawing off should be managed according to the spinning assembly so that it may be ensured that the yarn end is bound into the sliver ring. This happens in such a way that the drawing off of the newly pieced yarn is switched in as a function of yarn tension in the yarn that is being carried back. For this, a yarn tension sensor 82 is provided in the yarn path of servicing instrument 52, which trips this switching process. Because of different friction relationships in the yarn draw-off passages of the individual spinning assemblies and/or because of low pressures that differ somewhat in the spinning rotors, there may be deviations in the yarn tension between the individual spinning assemblies which can lead to imprecisions in the pieced places. The presenting and withdrawal of the yarn end on the sliver ring is to be adjusted to the rpm of spinning rotor 7, which runs up from its braked state to its operational rpm. The running up curves of spinning rotors 7 of the individual spinning assemblies 2 are essentially alike, of course, but there are switching delays in brake linkages 13 or the like of the individual assemblies that lead to a deviation. This can have the effect that the presentation of the yarn end to the sliver ring and also withdrawal may occur at unfavorable times so that either the piecing has an insufficient twist, or too much twist. Also, the temporal course of the running up of the spinning rotors has an influence, as to whether the quantity of sliver that is fed in will form a ring needed for the piecing that will have the correct composition. If the spinning rotor were to run up too late, there would be the risk that part of the sliver would be sucked off; i.e. if there were not a sufficient centrifugal force acting on the sliver.

Figures 3, 4, 5, 6:
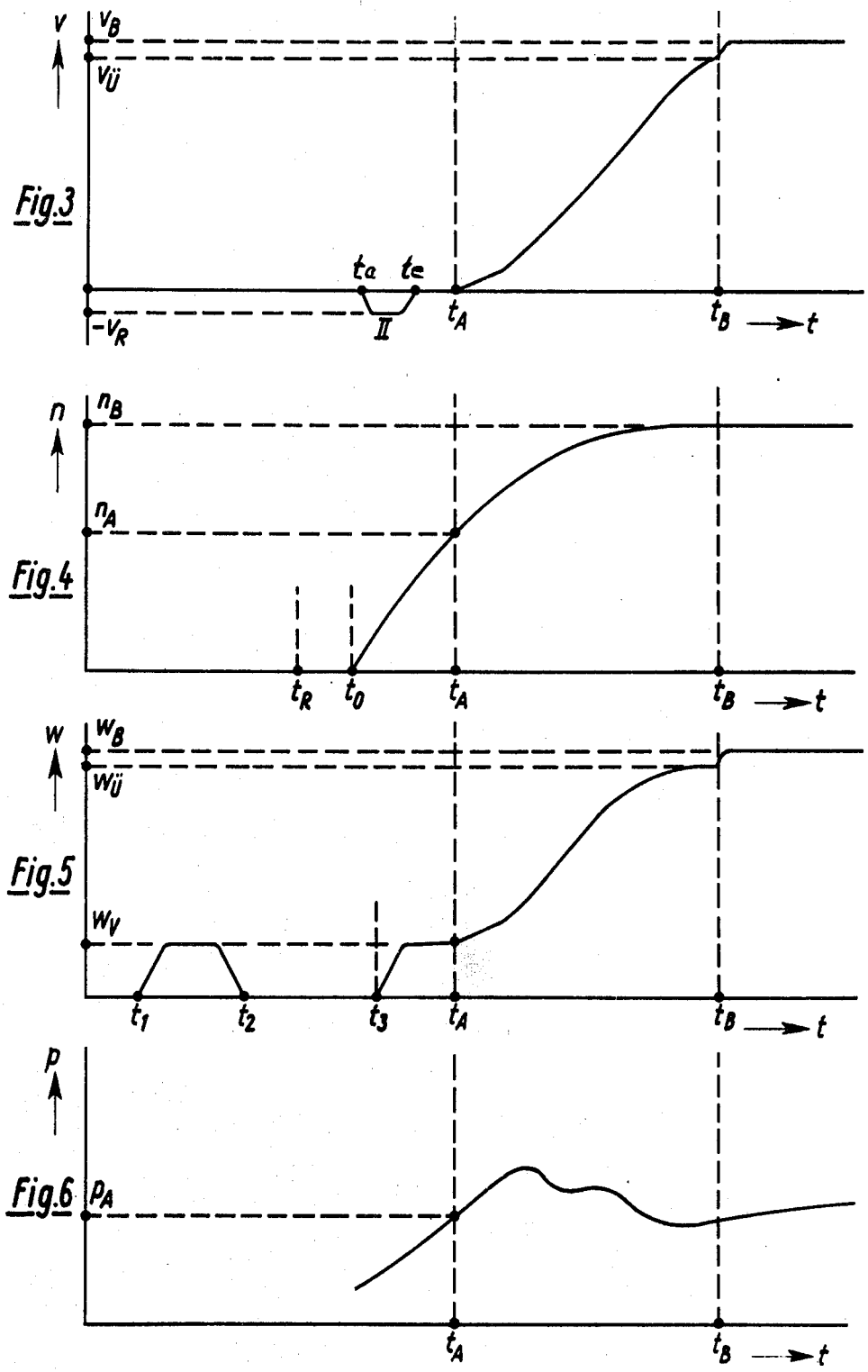
FIGS. 3 through 6 schematically, graphically depict the temporal order within a work program, with which the operations are controlled that engage in a spinning assembly.

In order to further illustrate the above remarks, the mentioned work courses are presented as diagrams in FIGS. 3 through 6, where the work courses are plotted over time. In FIG. 3, the yarn draw-off speed v is plotted over time t. At a time $t_a$ the yarn end is carried back into the spinning rotor against the normal draw-off direction of the yarn, at speed $v_R$. The interval between $t_a$ and $t_e$ corresponds to a specific yarn length. At a somewhat later time, piecing time $t_A$, there is the drawing off of the pieced yarn, whereby the draw-off speed is increased to a transfer speed $v_Ü$ with which the yarn is transferred to the spinning assembly. This draw-off speed is slightly below operational yarn draw-off speed $v_B$ at which the yarn is withdrawn from the spinning assembly. This operational state is reached at time $t_B$. In order not to have the yarn end tangle inside the yarn draw-off passage as it is carried back, it can likewise be provided that the carrying back of the yarn will occur between times $t_a$ and $t_e$ in a kind of step-back process ("Pilger" step) where the yarn end, after travelling a specific path, is pulled back a little. This can, of course, be limited to the path that the yarn end has to travel inside the yarn draw-off passage.

FIG. 4 shows the running up curve of a spinning rotor 7, where the rotor rpm n is plotted over time t. At time $t_R$ the brake mechanism of the rotor is released, via an actuating arm 58 (FIG. 1). After a given delay time within the mechanical parts of the brake linkage and the actuating mechanisms, the spinning rotor runs at time $t_o$ up to its operating rpm $n_B$ which is about 75,000 $min^{-1}$. In so doing, it passes through a piecing rpm $n_A$ at piecing time $t_A$. The piecing rpm $n_A$ can be, for example, 40,000 $min^{-1}$. The interval between $t_o$ and $t_B$ at which the rotor 7 reaches its operational rpm can be of the order of magnitude of 3.5 seconds.

FIG. 5 shows intake w for sliver 22 (FIG. 1) plotted over time t. To exclude the influence of the duration of stoppage time of the spinning assembly, intake for sliver feed is switched in at time $t_1$ and ended at time $t_2$, in which the spinning rotor is still stationary. This feed serves only to equalize and possibly shorten the sliver beard presented to the opener roll from the feed device. Since spinning rotor 7 at this time has not yet run up, the fibers fed in will be sucked off. At time $t_3$ the so-called "prior" feed will be undertaken, with an intake speed $w_V$. At the time of the beginning of the prior feed, the spinning rotor must have reached a minimum rpm so that the fibers will not be sucked off but will be held in the sliver collecting roove of the rotor. It is obvious that the sliver ring formed by the prior feed will only have the same configuration, i.e. the same quantity of sliver, if the interval between $t_3$ and piecing time $t_A$ is constant. At piecing time $t_A$ the intake speed will be increased until at operating time $t_B$ it reaches transfer speed $w_U$ which is a little below the operational intake speed $w_B$ of the spinning assembly. The time between piecing time $t_A$ and operating time or transfer time $t_B$ will be determined by the running up curve of the spinning rotor (FIG. 4) according to which the run up curve of yarn take-off (FIG. 3) is also directed.

In the diagram of FIG. 6, the yarn tension p is plotted over time. The measurement is taken on the yarn that is to be pieced, by tension sensor 82 of the servicing instrument 52.

In a practical embodiment of a servicing instrument, it is provided that a piecing tension $p_A$ will be established, which, when it is reached, will determine piecing time $t_A$, i.e. the drawing off of the yarn corresponding to running up curve of FIG. 3 and the increase in the intake speed of the sliver according to FIG. 5. Since yarn tension p is essentially dependent upon the rotor rpm before the start of yarn take off, this offers the advantage that any deviations that may occur in the range of the run up behavior of the spinning rotor can be more or less counterbalanced. If the piecing tension $p_a$ is arrived at at a point other than the time that is to be anticipated, then piecing time $t_A$ shifts to the right or left in the diagram. This means that formation of the sliver ring in the spinning rotor will, of necessity, be influenced, as determined by the start of prior sliver feed beginning at time $t_3$. If the interval between $t_3$ and $t_A$ is increased, we will have a thick place. If the interval between $t_3$ and $t_A$ decreases, this leads to a thin place or even to a failure because the yarn will immediately tear apart again.

Of course, there is also the possibility that the course of yarn tension p will vary independently of the run up behavior of the spinning rotor, so that piecing tension $p_A$ will be reached at the illustrated piecing time $t_A$ without any change whatsoever in the running up behavior of the spinning rotor. In this case piecing will be done at too low or too high an rpm, which can lead to inadequate twisting of the pieced place or to excessive twisting. Both not only reduce the quality of the piecing, but also lead to risk of failures in piecing attempts.

It is also possible, that the intake speed $w_V$ for the prior feed will not be obtained exactly at each spinning assembly because of the tolerances involved. The sliver ring that is formed then either has too much or too little sliver. This also will not only diminish the quality of the piecing but above all, with too little prior feed, there will be increased danger of failure of the piecing attempt.

Figure 2:
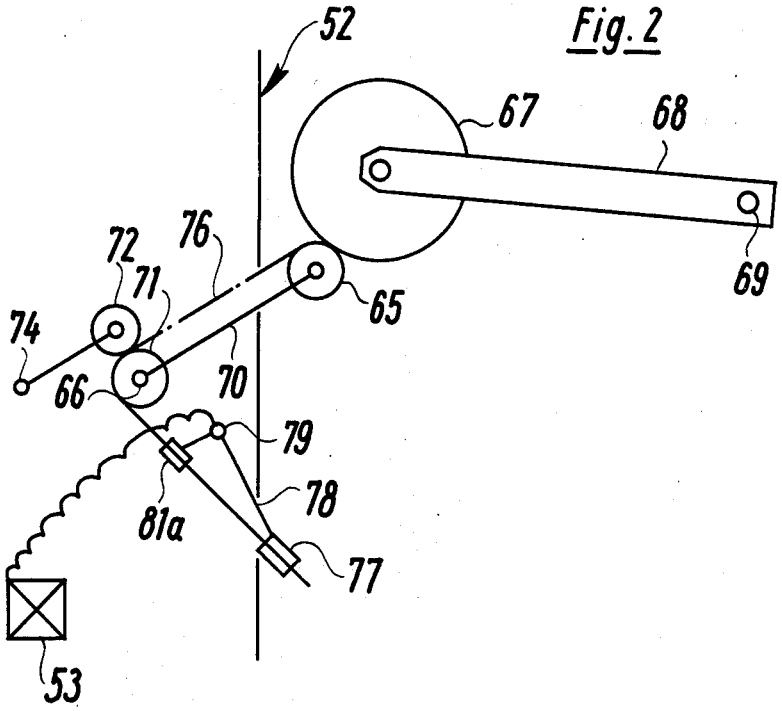
FIG. 2 is an enlarged partial view of a somewhat modified detail of the servicing device of FIG. 1.

It should be clear from the above comments that it would be favorable, per se, for production of optimal yarn piecings, to adjust the servicing instrument for each spinning assembly individually, which would lead in practice, however, to an intolerable expenditure because then every spinning assembly would, in practice, have to be equipped with its own servicing instrument. To be able to avoid this outlay and also to be able to service the various spinning assemblies with one common instrument, it is provided that the servicing instrument can be adapted to the spinning assemblies individually. It is provided that at least the operations shown in FIGS. 3, 4 and 5 can be adapted to each spinning assembly in that, for these operations, there is provision of a number of different work programs that can be selected according to the requirements of the spinning assembly in question. Selection of the suitable program is effected by a yarn test head 81, which according to the embodiment of FIG. 1, is on yarn clamp 77, or according to FIG. 2, is made as a special component. This yarn test head 81 checks the pieced yarn that has been drawn off again, for the presence of a pieced plate and/or the quality of the piecing. In this instance, the yarn test head can work optically and/or inductively in a known way, and determine the cross-section and/or the thickness and/or the length and/or the time of appearance of the pieced place.

If the yarn test head determines that the piecing attempt has failed, a changed work program is introduced in the place of the program that was used in the unsuccessful attempt. That is, a work program is used, whereby a so-called "safety" piecing is produced. For this it can be provided that the switch time $t_3$ (FIG. 5) for prior feed will be advanced so that before th piecing and drawing off of the yarn end there will be a sliver ring with more sliver. If now what is wanted is mainly to effect piecing successfully, it will be sufficient in some situations only to make a so-called "safety" piecing in this way. In the simplest case, this would mean that the testing head would only have to check whether, after the piecing, the yarn is running or there is a yarn break, whereby in case of a yarn break, there would be a repetition of the piecing attempt, using the program that produces a safety piecing.

If the quality of the yarn piecing is also to be improved, then the measurements from the yarn test head 81 would have to be evaluated, and thereafter there would be switchover to the appropriate work program with which the attempt to piece would be repeated. In some circumstances then, the attempt would have to be repeated several times until the most suitable program was found. In these programs, it would be advantageously provided that piecing time $t_A$ would also not be tension dependent any longer, but time-dependent as established by the work programs.

Figure 7:
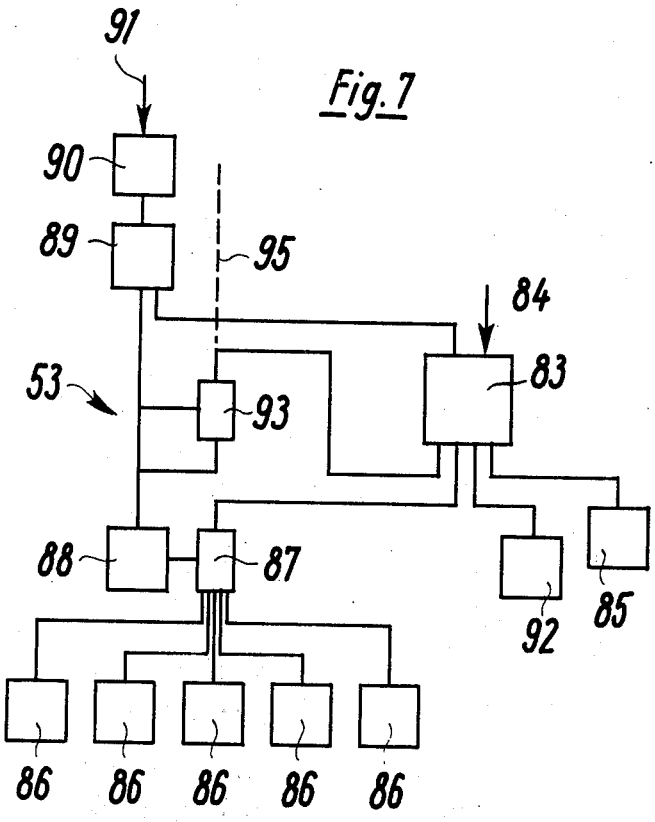
FIG. 7 schematically shows a program control in a block diagram, constructed in accordance with a preferred embodiment of the present invention.

In the block circuit diagram of program control 53 that is presented in FIG. 7, a main program 83 is provided to which a signal 84 is given, indicating the need of a spinning assembly for servicing. The main program then controls the travel mechanism of the servicing instrument so that the servicing instrument will stop at the spinning assembly in question and direct itself to the individual parts. It is also contemplated to provide that signal 84 which indicates the need for servicing will be transmitted to a control of the travel mechanism of the servicing instrument which then, for example when it has halted, will give a signal to the main program. Thereafter a preparatory program 85 will be started by the main program, whereby the work steps will be controlled that effect the taking of the yarn end from the spinning assembly in question, its preparation, and its holding in readiness upstream of the yarn draw off passage of the spinning assembly. In some situations the preparatory program will also control work steps that prepare the spinning assembly for the actual piecing operation, executing a cleaning operation or the like, for instance. One of the preparatory operations effects the braking of spinning rotor 7. Main program 83 then starts work program 86 which controls the work steps which engage in the spinning assembly. If it is desired to undertake a change in the drawn off yarn length for the individual piecing attempts, it would be appropriate if the work steps of yarn seeking and/or winding off were taken out of the preparatory program 85 and included in work program 86. As FIG. 7 shows, a number of independent programs are available as work program 86, so that an individual adaptation to the spinning assembly in question is possible. These work programs 86 are connected with the main program via a switch 87. Switchover to the appropriate work program 86 is effected via a setting member 88 to which setting signals are supplied from an evaluation stage 89. The evaluation stage checks the signals that it receives from a signal transmitter 90 in which measurements 91 are converted to signals, as determined by the yarn test head 81 on the yarn or on the yarn piecing. Main program 83 further controls a transfer program 92 which controls the transfer of the pieced yarn to the spinning assembly that is being serviced.

After the preparatory work processes have been executed by the preparatory program 85, main program 83 starts one of the work programs 86 that is connected directly to the main program via the switch. For this, advantageously a basic work program 86 which is the same for all spinning assemblies is selected. The piecing obtained by this piecing attempt is checked by yarn test head 81 which transmits its measurement 91 to signal transmitter 90 which transmits a signal that can be evaluated, to the evaluation stage. The evaluation stage compares the received signals with an ideal value for a yarn piecing. In case this is not attained, a signal is given to the main program 83, whereby the piecing process is interrupted. The transfer program 92 is then no longer started. The main program then rather provides a repetition of the piecing process. The evaluation stage further compares the transmitted signal with others which it has stored, to determine how the deviations from the ideal value look, and which work program would best be utilized in case of a defect like this. Via setting member 88, the switch 87 will then be switched over to the work program in question, so that the renewed piecing attempt will be made with this work program 86. The yarn piecing is then checked again, whereafter evaluation stage 89 decides if it is acceptable or not, i.e. if the piecing process can be completed by the transfer program or prematurely ended.

In order not to have to take the risk of a failure into account with each piecing process from the very beginning, it is advantageously provided that the signal of evaluation stage 89 which is transmitted to setting member 88 will be stored in a storage 93. If an identifying signal for the spinning assembly in question is also given to this storage, which can be done for example via signal 84 that is introduced into the main program, or via a special signal 95, then the main program 93 can call from storage 93 the signal that sets the correct program selection via setting member 88 and switch 87, before switchover to the work program. It is also possible and simpler in certain situations to place a storage of this kind on each spinning assembly which then receives a corresponding setting signal from the evaluation stage after successful piecing. This signal can then also be entered in the main program 83 in a later piecing operation.

While we have shown and described several embodiments in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

We claim:

1. A process for yarn piecing on an open-end spinning machine comprising:

returning a yarn end to piece the same with a fiber ring in a spinning rotor of a spinning assembly of the spinning machine, withdrawing the pieced yarn from the spinning assembly, and controlling the operations of said spinning assembly during piecing by way of a predetermined piecing control program, wherein a plurality of different piecing control programs are provided for accommodating selection of respective different programmed operating conditions of the spinning assembly during at least a portion of the piecing operations, wherein the quality or presence of the spun yarn at the intended piecing place is monitored during said withdrawing, wherein the selection of the piecing control program to be utilized for the next piecing operation at said spinning assembly is automatically made in dependence on the monitored quality or presence of the pieced place, and wherein the selection of the piecing control program to be utilized, when the next preceding piecing operation at said spinning assembly results in no pieced place, includes selection of a different control program than the one used in said next preceding piecing operation.

2. Process according to claim 1, further comprising transferring the spun yarn to the spinning assembly for normal spinning operations after said withdrawing.

3. Process according to claim 1, wherein the piecing control program selected is varied qualitatively as a function of the monitored quality of the pieced plate.

4. Process according to claim 1, further comprising storing information as to the piecing control program utilized during the last successful piecing operation at a spinning assembly, and utilizing said stored information to control selection of the same piecing control program during the next subsequent piecing operation at said spinning assembly.

5. Process according to claim 1, wherein said piecing control program includes means for controlling supply of sliver to a spinning rotor during piecing, with different piecing control programs effecting different rates of sliver supply.

6. Process according to claim 1, wherein said piecing control program includes means for controlling the velocity and acceleration characteristics of the spinning rotor during piecing, with different rotor velocity/acceleration characteristics for the respective different piecing control programs.

7. Process according to claim 1, wherein said piecing control program includes means for controlling the returning and withdrawing steps.

8. Process according to claim 1, wherein said spinning machine includes a plurality of commonly driven spinning assemblies, and wherein means for effecting said piecing are carried by a movable piecing device which is selectively operatively engageable with respective ones of said spinning assemblies.

9. Apparatus for yarn piecing on an open-end spinning machine comprising:

returning means for returning a yarn end to piece the same with a fiber ring in a spinning rotor of a spinning assembly of the spinning machine, withdrawing means for withdrawing the pieced yarn from the spinning assembly, piecing control program means for controlling the operations of said spinning assembly in a predetermined manner during piecing of said yarn and withdrawal thereof, said piecing control program means including a plurality of different piecing control programs for accommodating respective different programmed operating conditions of a spinning assembly during at least a portion of the piecing operations at said spinning assembly, yarn quality monitoring means for monitoring the quality or presence of the spun yarn at the intended piecing place, and program selecting means for automatically selecting one of the piecing control programs in dependence on the quality or presence of the spun yarn at the intended piecing place determined by the yarn quality monitoring means, wherein the program selecting means includes means for selecting a different control program than the one used in the next preceding piecing operation, whenever said next preceding piecing operation results in no pieced place.

10. Apparatus according to claim 9, wherein yarn transfer means are provided for transferring the spun yarn to the spinning assembly for normal spinning operations after the piecing operation.

11. Apparatus according to claim 9, wherein said piecing control program means includes means for qualitatively varying the piecing program as a function of the detected quality of the yarn piecing.

12. Apparatus according to claim 9, including:

devices for receiving and preparing a yarn end and the spinning assembly for the piecing process, and devices for transfer of the pieced yarn to the spinning assembly after piecing is completed, wherein said piecing control program means includes means for the control of the switching times and duration of switching of the individual devices, wherein a control element of the yarn quality monitoring means for checking the pieced yarn for the presence of a yarn piecing or for the quality of the yarn piecing is provided, wherein the program control means is equipped with a control element for interruption and repetition of the piecing operation, wherein the program selecting means includes a switching device connected to said piecing control programs, and wherein the control element is operatively connected with the program control means and the switching elements to effect said automatic selecting.

13. Apparatus according to claim 12, wherein the program control means includes an evaluation stage to which a signal is supplied that is dependent upon the measurement value of the control element, said evaluation stage being connected to the switching device connectible in turn selectively in series to the respective different piecing control programs.

14. Apparatus according to claim 12 or claim 13, wherein the switching device is connected with a signal output of a storage in which there is stored a switching signal associated with the last successful piecing program at the respective spinning assembly.

15. Apparatus according to claim 13, wherein said piecing control program means is disposed in a servicing instrument which can travel along a spinning machine and can be presented to respective individual spinning assemblies thereof.

16. Apparatus according to claim 15, wherein the switching device is connected with a signal output of a storage in which there is stored a switching signal associated with the last successful piecing program at the respective spinning assembly.

17. Apparatus according to claim 16, wherein the storage is a component of the servicing instrument, to which at each spinning assembly a signal transmitter transmits an identification signal.

18. Apparatus according to claim 15, wherein each spinning assembly is equipped with a storage that can be connected by the evaluation stage to the piecing control program means of the servicing instrument, said storage in turn being connectible to the piecing program control means to provude a switching signal for said switching device.

19. Apparatus according to claim 15, wherein said control element includes an optically, capacitively or inductively operated yarn testing head, disposed on the servicing instrument in the path of the pieced yarn, and arranged for determining changes in the yarn cross-section.

20. Apparatus according to claim 19, wherein a signal transmitter is connected to the yarn testing head, which transmitter in turn is connected with the evaluating stage and converts the measurements of the yarn testing head into signals that are associated with at least one of the time of the appearance of the yarn piecing in the yarn testing head, the thickness of the yarn piecing, and the length of the yarn piecing.

21. Apparatus according to claim 12, wherein the piecing control programs differ with respect to at least one of time of switch-in or duration of switching in of at least one of a device for delivery of sliver, a device for starting the run up of the spinning rotor, and a device for carrying the yarn end into the spinning rotor and point off the pieced yarn.

22. Apparatus according to claim 12, wherein said piecing control program means includes means for controlling supply of sliver to a spinning rotor during piecing, with different piecing control programs effecting different rates of sliver supply.

23. Apparatus according to claim 12, wherein said piecing control program means includes means for controlling the velocity and acceleration characteristics of the spinning rotor during piecing, with different rotor velocity/acceleration characteristics for the respective different piecing control programs.

24. Apparatus according to claim 12, wherein said piecing control program means includes means for controlling the returning and withdrawing steps.

25. Apparatus according to claim 22, wherein said piecing control program means includes means for controlling the velocity and acceleration characteristics of the spinning rotor during piecing, with different rotor velocity/acceleration characteristics for the respective different piecing control programs.

26. Apparatus according to claim 25, wherein said piecing control program means includes means for controlling the returning and withdrawing steps.

27. Process for yarn piecing on an open-end spinning machine comprising:

returning a yarn end to piece the same with a fiber ring in a spinning rotor of a spinning assembly of the spinning machine, withdrawing the pieced yarn from the spinning assembly, and controlling the operations of said spinning assembly during piecing by way of a predetermined piecing control program, wherein a plurality of different piecing control programs are provided for accommodating selection of respective different programmed operating conditions of the spinning assembly during at least a portion of the piecing operations, wherein the quality or presence of the spun yarn at the intended piecing place is monitored during said withdrawing, wherein the selection of the piecing control program to be utilized for the next piecing operation at said spinning assembly is automatically made in dependence on the monitored quality or presence of the pieced place, and wherein the piecing control program selected is varied qualtatively as a function of the monitored quality of the pieced place.

28. Process according to claim 27, wherein said spinning machine includes a plurality of commonly driven spinning assemblies, and wherein means for effecting said piecing are carried by a movable piecing device which is selectively operatively engageable with respective ones of said spinning assemblies.

29. Process for yarn piecing on an open-end spinning machine comprising:

returning a yarn end to piece the same with a fiber ring in a spinning rotor of a spinning assembly of the spinning machine, withdrawing the pieced yarn from the spinning assembly, and controlling the operations of said spinning assembly during piecing by way of a predetermined piecing control program, wherein a plurality of different piecing control programs are provided for accommodating selection of respective different programmed operating conditions of the spinning assembly during at least a portion of the piecing operations, wherein the quality or presence of the spun yarn at the intended piecing place is monitored during said withdrawing, wherein the selection of the piecing control program to be utilized for the next piecing operation at said spinning assembly is automatically made in dependence on the monitored quality or presence of the pieced place, further comprising storing information as to the piecing control program utilized during the last successful piecing operation at a spinning assembly, and utilizing said stored information to control selection of the same piecing control program during the next subsequent piecing operation at said spinning assembly.

30. Process according to claim 29, wherein said spinning machine includes a plurality of commonly driven spinning assemblies, and wherein means for effecting said piecing are carried by a movable piecing device which is selectively operatively engageable with respective ones of said spinning assemblies.

31. Apparatus for yarn piecing on an open-end spinning machine comprising:

returning means for returning a yarn end to piece the same with a fiber ring in a spinning rotor of a spinning assembly of the spinning machine, withdrawing means for withdrawing the pieced yarn from the spinning assembly, piecing control program means for controlling the operations of said spinning assembly in a predetermined manner during piecing of said yarn and withdrawal thereof, said piecing control program means including a plurality of different piecing control programs for accommodating respective different programmed operating conditions of a spinning assembly during at least a portion of the piecing operation at said spinning assembly, yarn quality monitoring means for monitoring the quality or presence of the spun yarn at the intended piecing plate, and program selecting means for automatically selecting one of the piecing control programs in dependence on the quality or presence of the spun yarn at the intended piecing place determined by the yarn quality monitoring means, wherein said piecing control program means includes means for qualitatively varying the piecing program as a function of the detected quality of the yarn piecing.

32. Apparatus according to claim 31, wherein said piecing control program means is disposed in a servicing instrument which can travel along a spinning machine and can be presented to respective individual spinning assemblies thereof.

33. Apparatus for yarn piecing on an open-end spinning machine comprising:

returning means for returning a yarn end to piece the same with a fiber ring in a spinning rotor of a spinning assembly of the spinning machine, withdrawing means for withdrawing the pieced yarn from the spinning assembly, piecing control program means for controlling the operations of said spinning assembly in a predetermined manner during piecing of said yarn and withdrawal thereof, said piecing control program means including a plurality of different piecing control programs for accommodating respective different programmed operating conditions of a spinning assembly during at least a portion of the piecing operations at said spinning assembly, yarn quality monitoring means for monitoring the quality or presence of the spun yarn at the intended piecing place, and program selecting means for automatically selecting one of the piecing control programs in dependence on the quality or presence of the spun yarn at the intended piecing place determined by the yarn quality monitoring means, wherein said program selecting means includes means for automatically selecting the same piecing control program as used on the next preceding successful piecing operation at said spinning assembly.

34. Apparatus according to claim 33, wherein said piecing control program means is disposed in a servicing instrument which can travel along a spinning machine and can be presented to respective individual spinning assemblies thereof.

* * * * *